United States Patent [19]

Wolf

[11] Patent Number: 4,991,220

[45] Date of Patent: Feb. 5, 1991

[54] MICROPHONE SUPPORT MEMBER

[75] Inventor: Konrad Wolf, Bad Vöslau, Austria

[73] Assignee: AKG Akustische u. Kino-Geräte Gesellschaft m.b.H.

[21] Appl. No.: 319,412

[22] Filed: Mar. 3, 1989

[30] Foreign Application Priority Data

Mar. 7, 1988 [AT] Austria ..... A 593/88

[51] Int. Cl.[5] ..... H04R 1/02

[52] U.S. Cl. ..... 381/169; 381/188; 381/205

[58] Field of Search ..... 381/188, 205, 169, 168, 381/158; 181/198, 207, 208

[56] References Cited

U.S. PATENT DOCUMENTS

| | | | |
|---|---|---|---|
| 2,717,932 | 9/1955 | Rackham et al. | 381/158 |
| 3,153,123 | 10/1964 | Harman | 381/169 |
| 3,573,401 | 4/1971 | Liniger | 381/169 |
| 3,653,625 | 4/1972 | Plice | 381/169 |
| 3,924,083 | 12/1975 | Hagey | 381/205 |
| 4,194,096 | 3/1980 | Ramsey | 381/205 |
| 4,396,807 | 8/1983 | Brewer | 381/205 |
| 4,514,598 | 4/1985 | Plice | 381/169 |
| 4,577,070 | 3/1986 | Shulman | 381/205 |
| 4,791,674 | 12/1988 | Drever | 381/169 |
| 4,811,405 | 3/1989 | Peiker | 381/169 |

FOREIGN PATENT DOCUMENTS

| | | | |
|---|---|---|---|
| 1537681 | 9/1969 | Fed. Rep. of Germany | 381/169 |

*Primary Examiner*—Jin F. Ng
*Assistant Examiner*—M. Nelson McGeary, III.
*Attorney, Agent, or Firm*—Toren, McGeady & Associates

[57] ABSTRACT

An elastic or shock-absorbing support member for a microphone. The support member includes a single hose member shaped in the form of an elastic loop. In comparison to its other dimensions, the elastic loop has a very thin wall and an inner diameter which is approximately twice the width of the loop. The loop connects a clamping piece supporting the microphone or the microphone housing to a connecting piece of a tripod.

9 Claims, 2 Drawing Sheets

MICROPHONE SUPPORT MEMBER

BACKGROUND OF THE INVENTION

1. Field of the Invention

The present invention relates to an elastic or shockabsorbing support member for a microphone whose elastic portion is a hose member, particularly for damping mechanical vibrations.

2. Description of the Related Art

Mechanical vibrations are generated by friction of bodies and objects, shaking of machines, stepping on floors and other vibrations and are conducted to the system capable of vibrating of the microphone through the tripod, the gooseneck, the microphone base or the microphone housings. Elastic or shock-absorbing mountings and supports of the microphones are used for damping these vibrations.

An elastic support member for microphones is known from U.S. Pat. No. 3,653,625. The support member has an elastic portion formed of a closed, toroidal tube which surrounds the microphone housing and is fastened to the tripod by means of a clamp which partially surrounds the tube. This tube-like member defines in its interior a narrow, oblong hollow space which is filled with a pressurized gas, liquid, gel or foam material. The viscosity of the filling of the tube determines the degree of damping. Thus, by different combinations of filling materials it is possible to make specific adjustments for special applications.

Another known device for damping the transmission of mechanical vibrations to the microphone includes a cylindrical member which is provided with grooves. O-rings are placed in the grooves, so that the cylindrical member can slide by means of the 0-rings in a hollow cylinder. This microphone support device is described in U.S. Pat. No. 3,153,123 and prevents mechanical vibrations from being transmitted from the tripod or the microphone stand to the microphone.

It is, therefore, the primary object of the present invention to provide a simple microphone support member which is also suitable for miniature microphones and which may be integrated in the microphone and which substantially dampens the transmission of mechanical vibrations.

SUMMARY OF THE INVENTION

In accordance with the present invention, the support member includes a single hose in the form of a closed elastic loop. In comparison to the other dimensions, the elastic loop has a very thin wall and an inner diameter which is approximately twice the width of the loop. The loop connects the clamping sleeve supporting the microphone or the microphone housing to the connecting piece of the tripod.

The hose-like loop not only has the advantage that it can be made very small but that it is possible in dependence on the material and wall thickness to vary its elasticity and its internal friction which acts to dampen vibrations. In addition, such a loop-like member is the simplest possible elastic or shock-absorbing connection between two rigid components, such as, the threaded connection piece for the entire support member and a clamping piece for receiving the microphone.

The support member according to the present invention has the additional advantage that the elastic hose member is resilient in all directions, so that an elastic deflection of the support member with the attendant damping is effected in all directions independently of the direction from which an impact occurs onto the microphone and independently of the direction of vibrations acting on the microphone from the outside. As a result, the support member according to the present invention prevents more effectively than previously known elastic support members the transmission of mechanical vibrations and of mechanical impacts on the microphone. The support device according to the invention provides an effective damping action of up to 30 dB.

Since it is common and possible today to miniaturize microphones, it is even possible to make a microphone which is so small that it is the same size as the clamping sleeve. However, in such a case it is simpler to use the microphone housing in place of the clamping sleeve. The connection to the elastic loop member is effected, for example, by means of a glued connection. However, a mechanical connection by means of screws is also possible.

In accordance with an advantageous development of the invention, the loop member is of an elastic plastics material. As a result, the elastic connecting member proper can be manufactured simply and a suitable material can be selected for providing the required elasticity while simultaneously achieving the critical damping action.

In accordance with another advantageous feature of the present invention, the loop member is of butyl rubber. Experience has shown that butyl rubber has excellent elastic and damping properties, so that the elastic support member for microphones according to the present invention provides an excellent damping action of the transmission of mechanical vibrations.

In accordance with an advantageous structural feature of the present invention, the loop member is connected to the tripod connecting piece and the clamping sleeve by means of a surface-to-surface glued connection. It is an advantage if the components are glued together when the tripod connecting piece and the clamping sleeve are made of a material which is different than that of the elastic loop member. In certain types of applications, it may be necessary to make the tripod connecting piece and the clamping sleeve of metal or a nonelastic plastics material so that a rigid connection between the individual components is only possible by means of a glued connection.

The simplest and least expensive manner of manufacturing the support member according to the present invention is to make the entire support member in one piece of elastic plastics material by injection molding. By selecting a suitable material of the support member, for example, a polyester elastomer material sold by the DuPont Corporation under the trade name Hytrel, and by correctly dimensioning the wall thicknesses of the support member, it is possible to manufacture the support member in one piece, so that the tripod connecting piece and the clamping sleeve have sufficient strength and hardness for their operation, while the loop member remains sufficiently elastic for the required resilient property thereof. In addition, the manufacture of the entire support member in one piece results in the best connection of the individual components and the best possible strength. By using a multiple injection mold, it is possible to produce several support members simultaneously in one injection molding process, which advantageously lowers the cost for each individual support member.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DESCRIPTION OF THE PREFERRED EMBODIMENT

Figure 1:
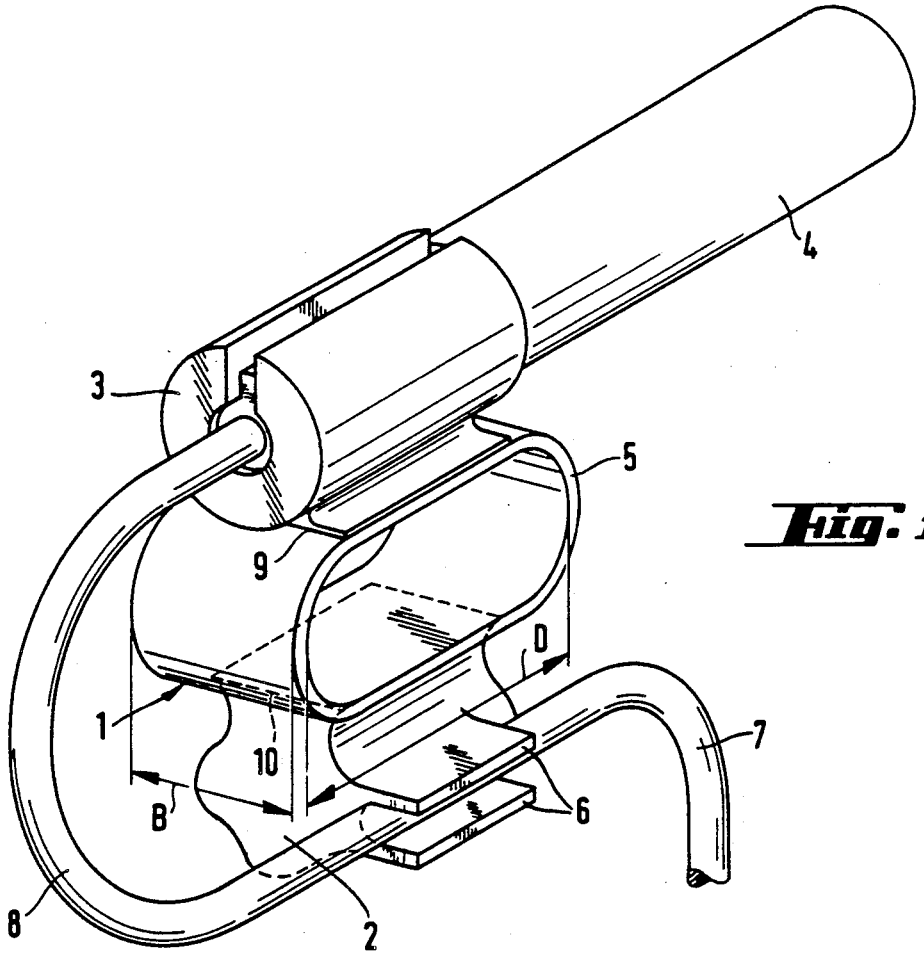
FIG. 1 is a perspective view of the elastic support member according to the present invention.

The elastic support member for a microphone shown in FIG. 1 includes an elastic, hose-shaped loop 1 which connects the tripod connecting piece 2 to the clamping sleeve 3 which supports the microphone 4.

In accordance with the present invention, the loop 1 has a very thin wall 5 and the inner diameter D of the loop is approximately twice the width B of the support member.

Figure 3:
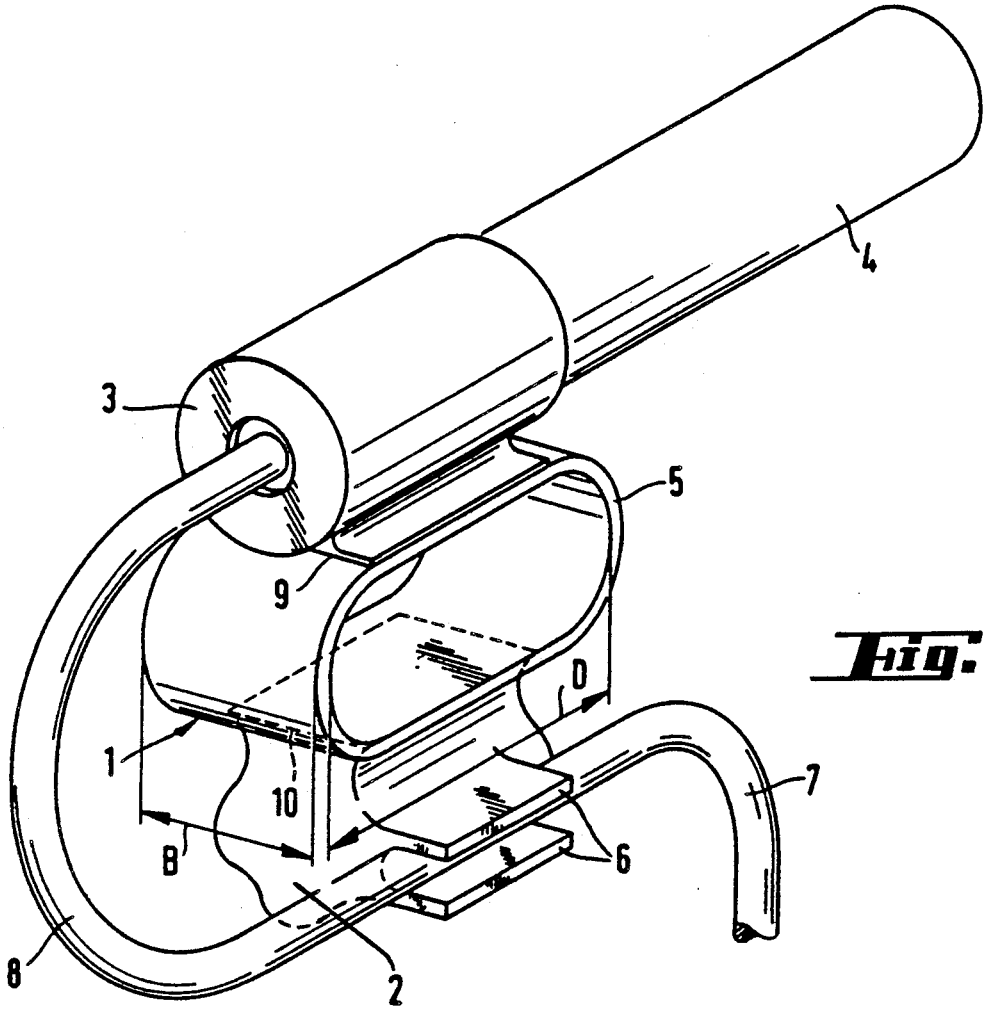
FIG. 3 shows another embodiment of the support member.

The tripod connecting piece 2 has a lateral clamping device 6 for the microphone cable 7. As a result, the microphone cable 7 assumes the shape of the loop 8 and also prevents the transmission of mechanical vibrations. It is certainly possible that the microphone 4 is so small that it has the same size as the clamping sleeve 3. In this case, the microphone housing is directly connected to the loop 1, as shown in FIG. 3. This type of arrangement is of particular practical value because of the increasing miniaturization of the microphones.

When the elastic hose-shaped loop member 1, the tripod connecting piece 2 and the clamping sleeve 3 are connected to each other by glued connections, the connections are effected over large surface areas on the surfaces 9 and 10. The possibility of manufacturing the components in one piece by injection molding has already been mentioned above.

Figure 2:
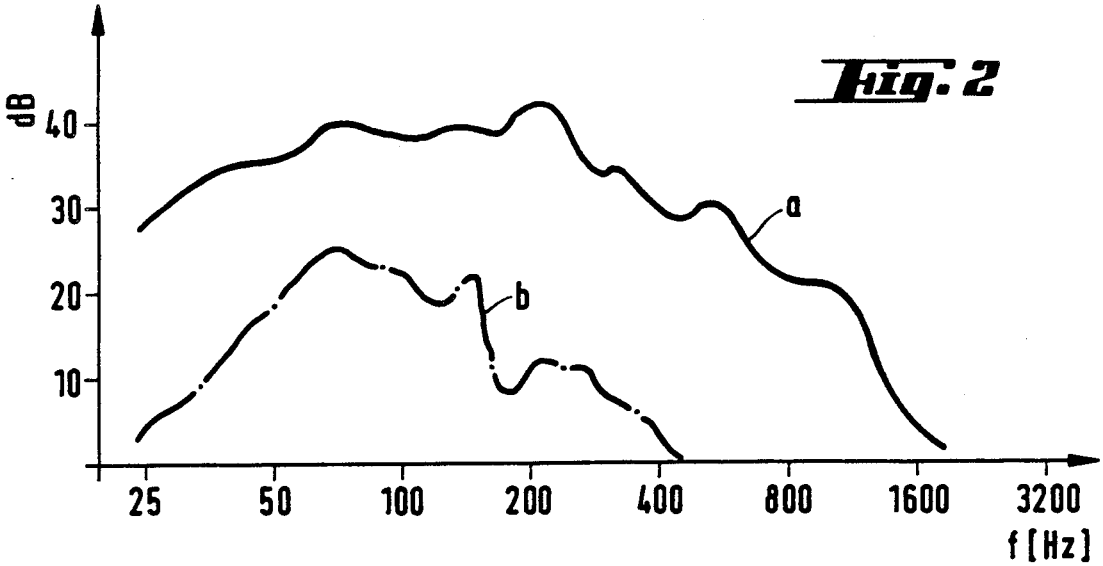
FIG. 2 shows the damping pattern in dependence on the frequency of the support member according to the present invention.

The effective damping of the mechanical vibration transmission is seen in the graph of FIG. 2. The distance existing between the curves a and b shows the magnitude of the damping in dB for a certain frequency. Specifically, curve a shows the frequency-dependent pattern of the spurious signal without elastic support member, while the curve b shows the signal as damped by means of the elastic support member.

While a specific embodiment of the invention has been shown and described in detail to illustrate the application of the inventive principles, it will be understood that the invention may be embodied otherwise without departing from such principles.

I claim:

1. An elastic support member for a microphone, the support member adapted to be mounted between a tripod connecting piece and a clamping sleeve supporting the microphone, the support member comprising a single hose member shaped in the form of an elastic loop, the hose member having a width, a wall thickness and an inner diameter, the wall thickness being very thin in relation to the width, and the inner diameter being approximately twice the width.

2. The support member according to claim 1, wherein the hose member is of elastic plastic material.

3. The support member according to claim 1, wherein the hose member is of butyl rubber.

4. The support member according to claim 1, wherein the hose member forming the loop has first and second surfaces, the first surface being glued to the tripod connecting piece and the second surface being glued to the clamping sleeve.

5. The support member according to claim 1, wherein the hose member forming the loop is an injection molded piece formed in one piece with the tripod connecting piece and the clamping sleeve.

6. An elastic support member for a microphone, the support member adapted to be mounted between a tripod connecting piece and a housing of the microphone, the support member comprising a single hose member shaped in the form of an elastic loop, the hose member having a width, a wall thickness and an inner diameter, the wall thickness being very thin in relation to the width, and the inner diameter being approximately twice the width.

7. The support member according to claim 6, wherein the hose member is of elastic plastic material.

8. The support member according to claim 6, wherein the hose member is of butyl rubber.

9. The support member according to claim 6, wherein the hose member forming the loop has first and second surfaces, the first surface being glued to the tripod connecting piece and the second surface being glued to the microphone housing.

* * * * *